United States Patent [19]

Ratell, Jr.

[11] Patent Number: 4,497,616

[45] Date of Patent: Feb. 5, 1985

[54] HYDRAULICALLY-OPERATED PUMP JACK WITH CHAIN DRIVE

[76] Inventor: Raymond E. Ratell, Jr., Rte. 305, R.D. #4, Warren, Ohio 44481

[21] Appl. No.: 493,070

[22] Filed: May 9, 1983

[51] Int. Cl.[3] ..... F04B 47/04

[52] U.S. Cl. ..... 417/390; 92/137; 60/369; 417/399

[58] Field of Search ..... 92/137; 60/369, 370, 60/371, 372; 166/68.5, 72, 98; 417/390, 398, 399

[56] References Cited

U.S. PATENT DOCUMENTS

| | | | |
|---|---|---|---|
| 2,874,641 | 2/1959 | McCandlish et al. | 60/372 X |
| 2,949,861 | 8/1960 | Heath | 417/399 X |
| 3,115,086 | 12/1963 | Stimmel | 60/372 X |
| 4,299,545 | 11/1981 | Bever | 417/401 |
| 4,346,620 | 8/1982 | Stanton | 60/369 |
| 4,432,706 | 2/1984 | Gilbertson | 417/399 |

*Primary Examiner*—Leonard E. Smith

*Attorney, Agent, or Firm*—Michael Williams; Warren N. Low

[57] ABSTRACT

My invention relates to pumping apparatus, particularly to a hydraulically-operated pump jack for oil, brine water and the like. The apparatus is fabricated from steel plate to make a strong, but light-weight tower which may be easily transported from one site to another by a small boom truck or gin pole truck. In contrast to pump jacks of the walking beam type which are massive in size, my improved pump jack is compact and is seated on and secured directly to the head of an oil well casing. A vertically-arranged hydraulic cylinder has its piston rod connected to a cross head on which a pair of sprockets are journalled. Chains pass around respective sprockets, one reach of each chain extending upwardly and is anchored to a stationary part of the tower. The other reach of each chain extends upwardly and over and around an upper sprocket journalled on a shaft carried by the upper end of the tower, each chain then extending downwardly to a yoke to which the polish rod is connected. This arrangement will result in a 2 to 1 ratio between the movement of the polish rod and the stroke of the hydraulic cylinder.

20 Claims, 13 Drawing Figures

50
54
60
66
83
74
86
78
75
85
L1
50b
50a
L2
46
87
48
78
79a
76
83
95
96
94
97
24
40
93
100
98
43
99
101
92.2
92.4
44
ACC.
102
OIL COOLER
105
92.3
92
88
TANK
91
PUMP
MOTOR
89
90

HYDRAULICALLY-OPERATED PUMP JACK WITH CHAIN DRIVE

BACKGROUND AND SUMMARY

A prior patent to A. P. McCandlish et al., U.S. Pat. No. 2,874,641, discloses a pump jack which is believed to be the closest approach to the invention herein disclosed. In this patent, a head is attached to the piston rod of an upright hydraulic cylinder, the head providing a bearing for a cross shaft to which a pair of sprockets are attached. A chain is trained over each sprocket, one reach of the chain extending down to a crosshead to which the polish rod is attached, and the other reach of each chain extending down to a stationary support on the tower.

When the rod of the cylinder in the McCandlish patent is moved upwardly to elevate the polish rod and the string of sucker rods attached thereto, a very great amount of stress is applied to the sprockets since they must not only rotate but also move bodily upwardly. Further, since the piston rod of the McCandlish pump jack is extended when it lifts the polish rod, great stress is applied to the rod bearings.

In contrast, in my improved pump jack, the upper sprockets do not move bodily, but merely rotate. Further, to elevate the polish rod, the piston rod is drawn into the hydraulic cylinder and the rod bearings are therefor not subjected to the great amount of stress, as before mentioned.

The pump jack of my invention is of simplified construction whereby it may be manufactured and sold at a comparatively low cost. The pump jack is mounted directly upon the head of an oil well casing so that it is unnecessary to provide special location preparation. The improved pump jack is fully automatic in operation and includes simplified controls to vary the acceleration or deceleration of the pumping stroke and to eliminate the "hammering" effect of high pressure hydraulic systems upon rapid reversal of the flow of the operating fluid.

DESCRIPTION OF THE DRAWINGS

In the drawings accompanying this specification and forming a part of this application, there is shown, for purpose of illustration, an embodiment which my invention may assume, and in these drawings.

DESCRIPTION OF THE PREFERRED EMBODIMENT

Figure 1:
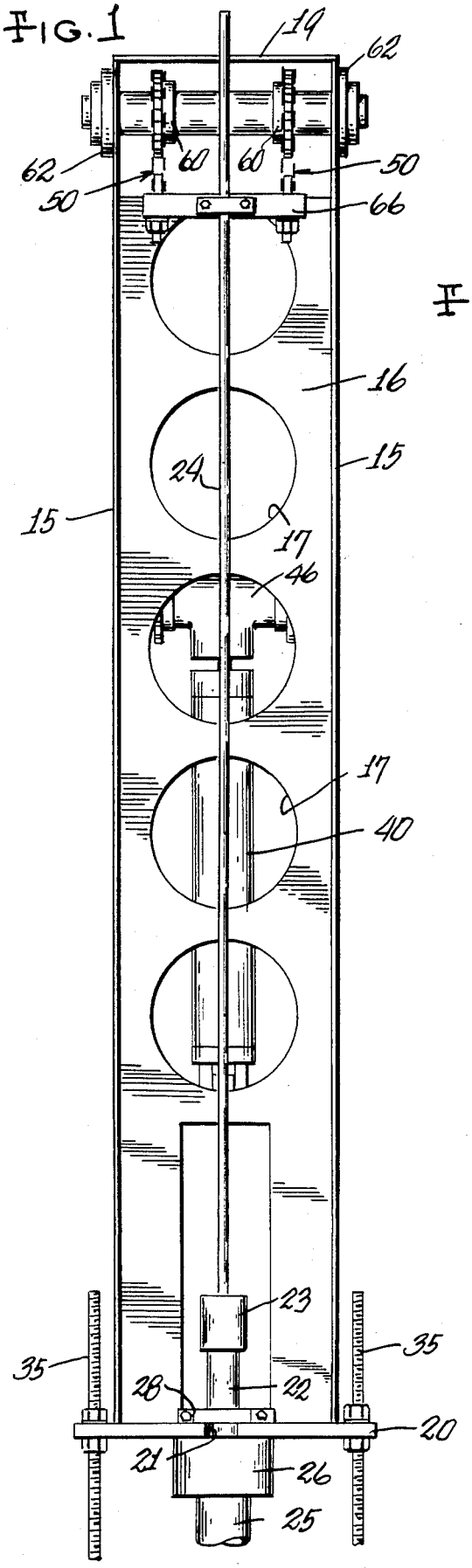
FIG. 1 is a front elevational view of a pump jack illustrating a preferred concept of my invention.
Figure 2:
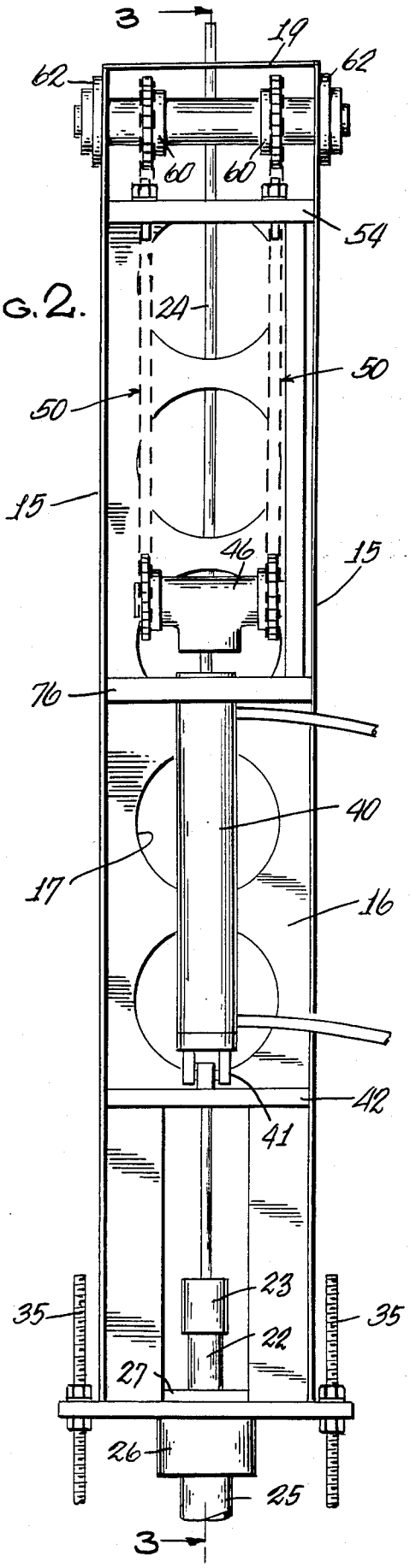
FIG. 2 is a rear elevational view thereof.
Figure 3:
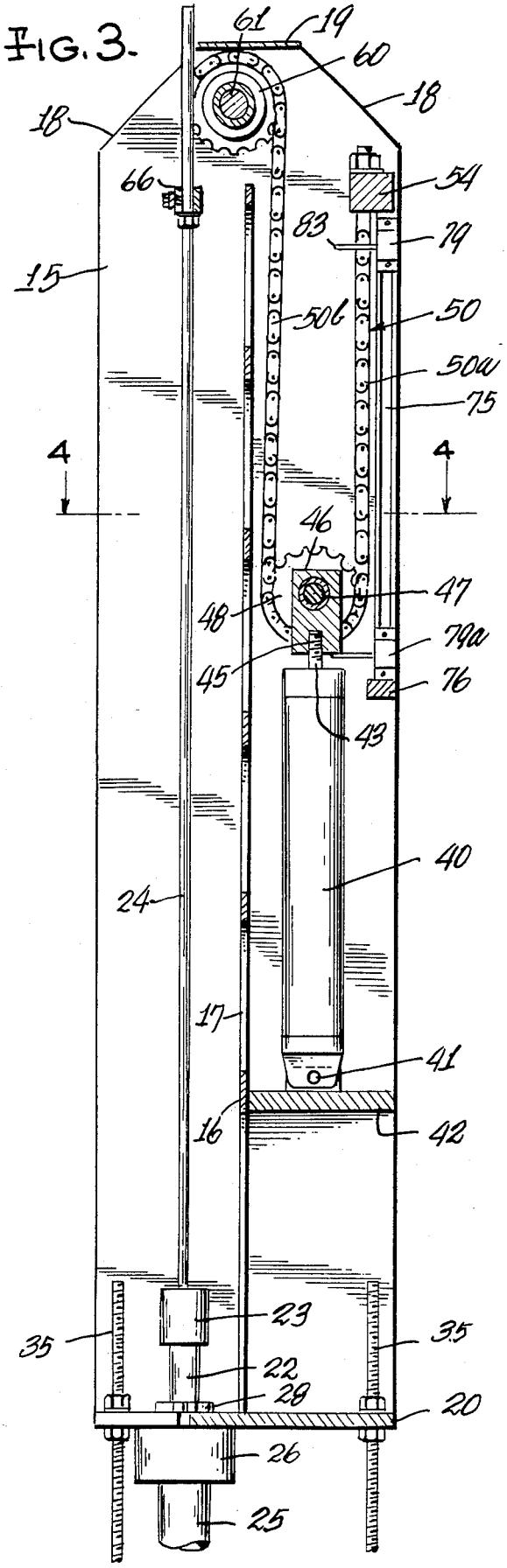
FIG. 3 is a cross sectional view corresponding to the line 3—3 of FIG. 2, certain parts being shown in elevation.

As seen in FIGS. 1 through 3, the tower is made of steel plate, welded together so as to possess low weight and great strength. The tower comprises a pair of elongated, vertically-disposed side plates 15,15 held in spaced relation by a center plate 16 which is welded to respective side plates. The center plate, or web, is formed with burned-out holes 17 to reduce weight without sacrificing strength.

Figure 6:
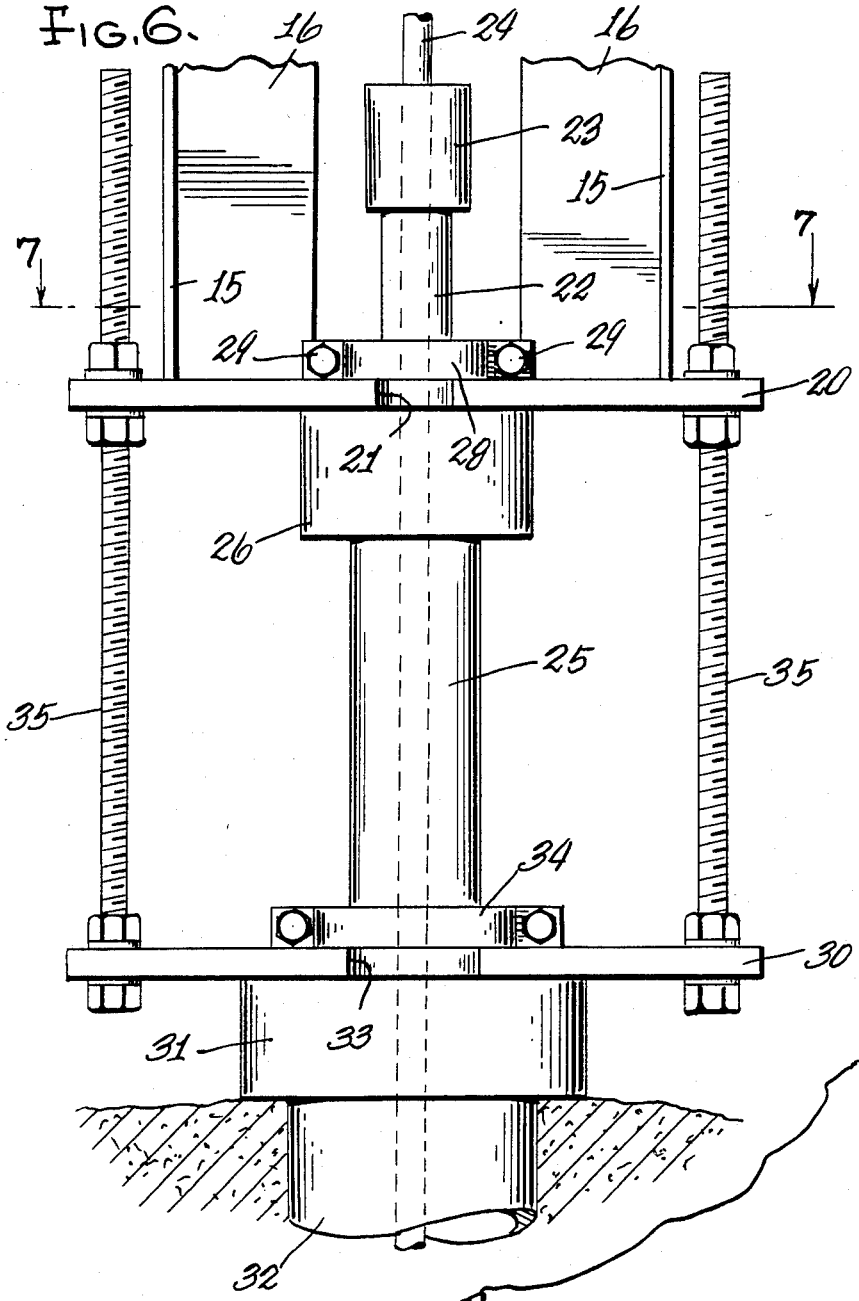
FIG. 6 is an enlarged, fragmentary view showing the lower end of the tower and its attachment to the head of an oil well casing.
Figure 7:
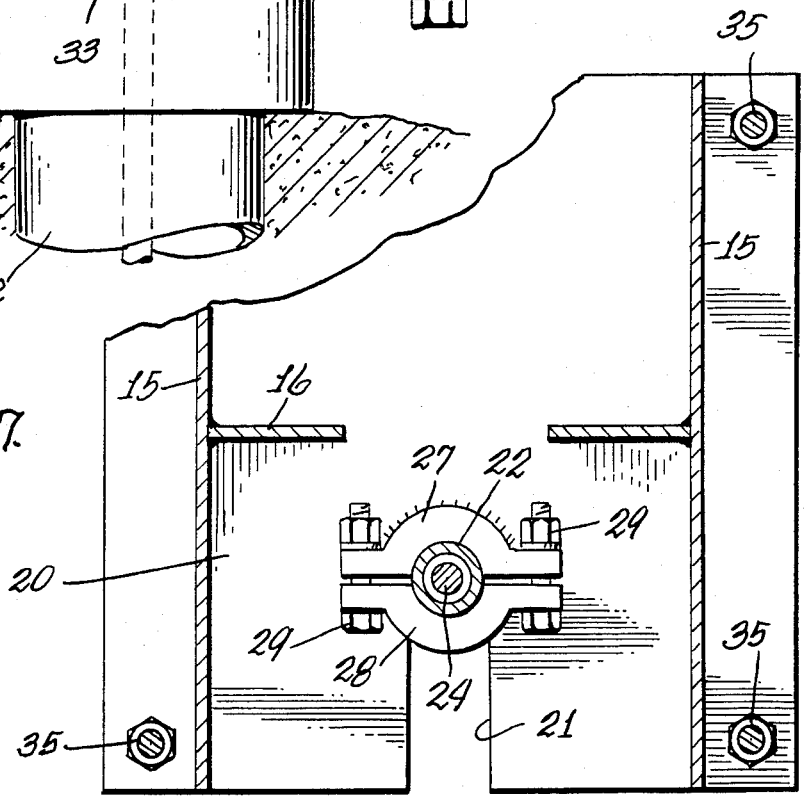
FIG. 7 is a transverse sectional view corresponding to the line 7—7 of FIG. 6, parts being broken away to fit the view to the sheet.
Figure 8:
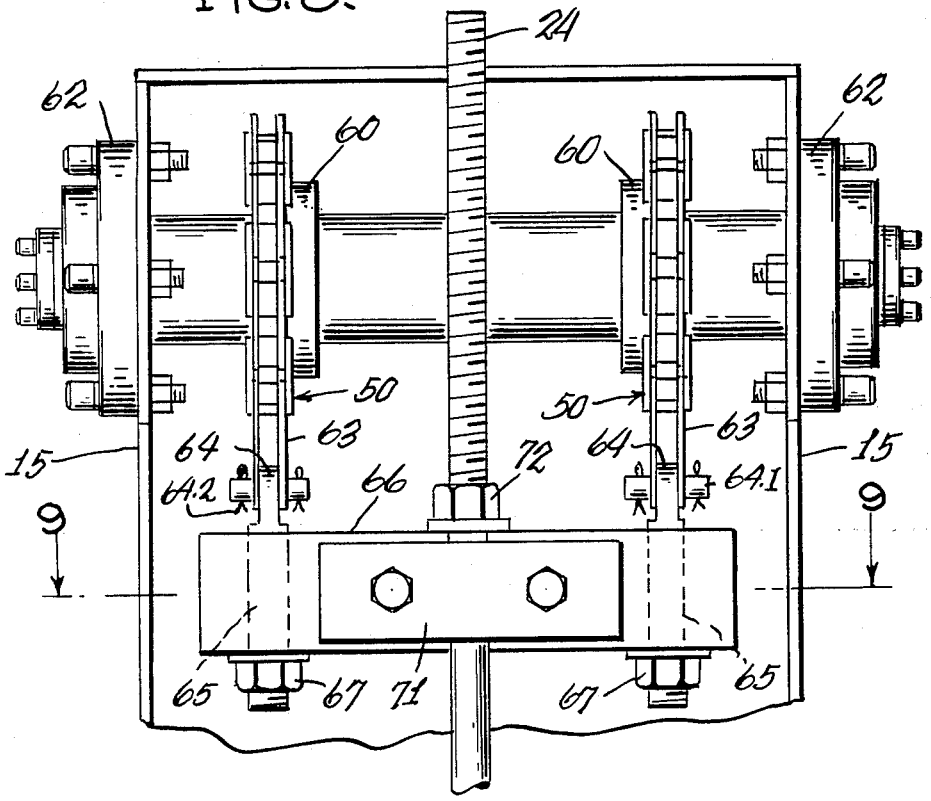
FIG. 8 is an enlarged, fragmentary view showing the upper end of the tower, as viewed from the front.
Figure 9:
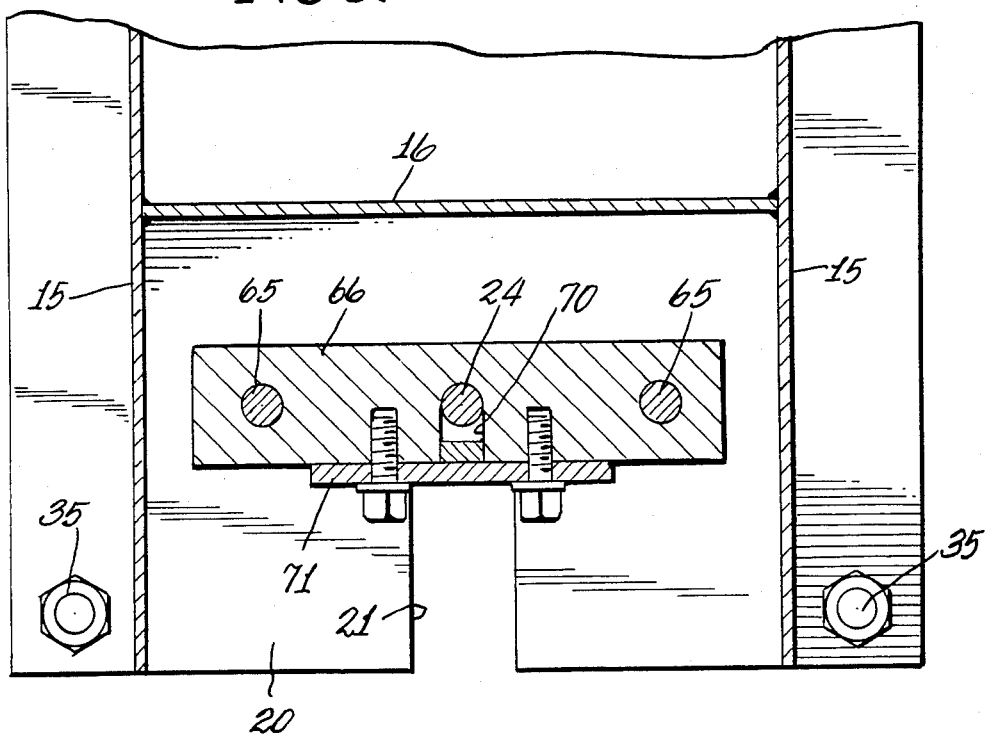
FIG. 9 is a fragmentary transverse sectional view corresponding to the line 9—9 of FIG. 8.

At the upper end of the tower, the side plates have converging angled surfaces 18 and a top plate 19 is welded across the top of the side plates. At the lower end of the tower, as best seen in FIG. 6, the side plates 15 and center plate 16 are welded to the top surface of a sturdy transversely-exending upper support plate 20. The plate 20 has a slot 21 (see FIG. 7) entering from margin thereof so that the plate may be assembled around the pump line 22 of the well casing. The line 22 normally has a stuffing box 23 at its upper end so that the polish rod 24 may reciprocate therethrough in leak-proof manner.

A run pipe 25 of the well casing is connected to the lower end of the pump line 22 by means of a stuffing box 26 and the upper surface of the latter provides a ledge upon which the upper support plate 20 rests. The support plate 20, and therefor the pump tower, is firmly connected to the pump line 22 by means of a split clamp which has one part 27 (FIG. 7) welded to the upper surface of the plate and the other part 28 drawn around the pump line 22 by nut and bolt connections 29.

A sturdy, transversely-extending lower support plate 30 is disposed below the plate 20 and seats on the upper surface of a stuffing box 31 which connects the run pipe 25 to the surface casing 32 of the oil well.

Like the plate 20, the plate 30 has a slot 33 entering from margin thereof and adapted to be aligned with the slot 21 so that the tower may be assembled with the well tubing by lateral bodily movement. The lower support plate 30 is firmly connected to the run pipe 25 by a split clamp 34 similar to the clamp 27–28.

Since the distances between the upper surfaces of the stuffing boxes 26 and 31 (or any other ledge-providing surfaces on the well casing) may vary from well to well, the plates 20 and 30 are connected at their four corresponding corners by threaded rods 35 so that the vertical distance between the plates 20 and 30 may be varied to properly seat on the ledge surfaces.

As best seen in FIG. 3, the lower, and blank end of a hydraulic cylinder 40, is pivoted at 41 to lugs which extend upwardly from a cross plate 42 which is welded to the side plates 15,15 and center plate 16 of the tower. A piston rod 43 extends upwardly from the piston 44 (FIG. 11) and the upper end of the rod is threaded, as at 45, for reception in a threaded socket in a cross head 46.

Figure 10:
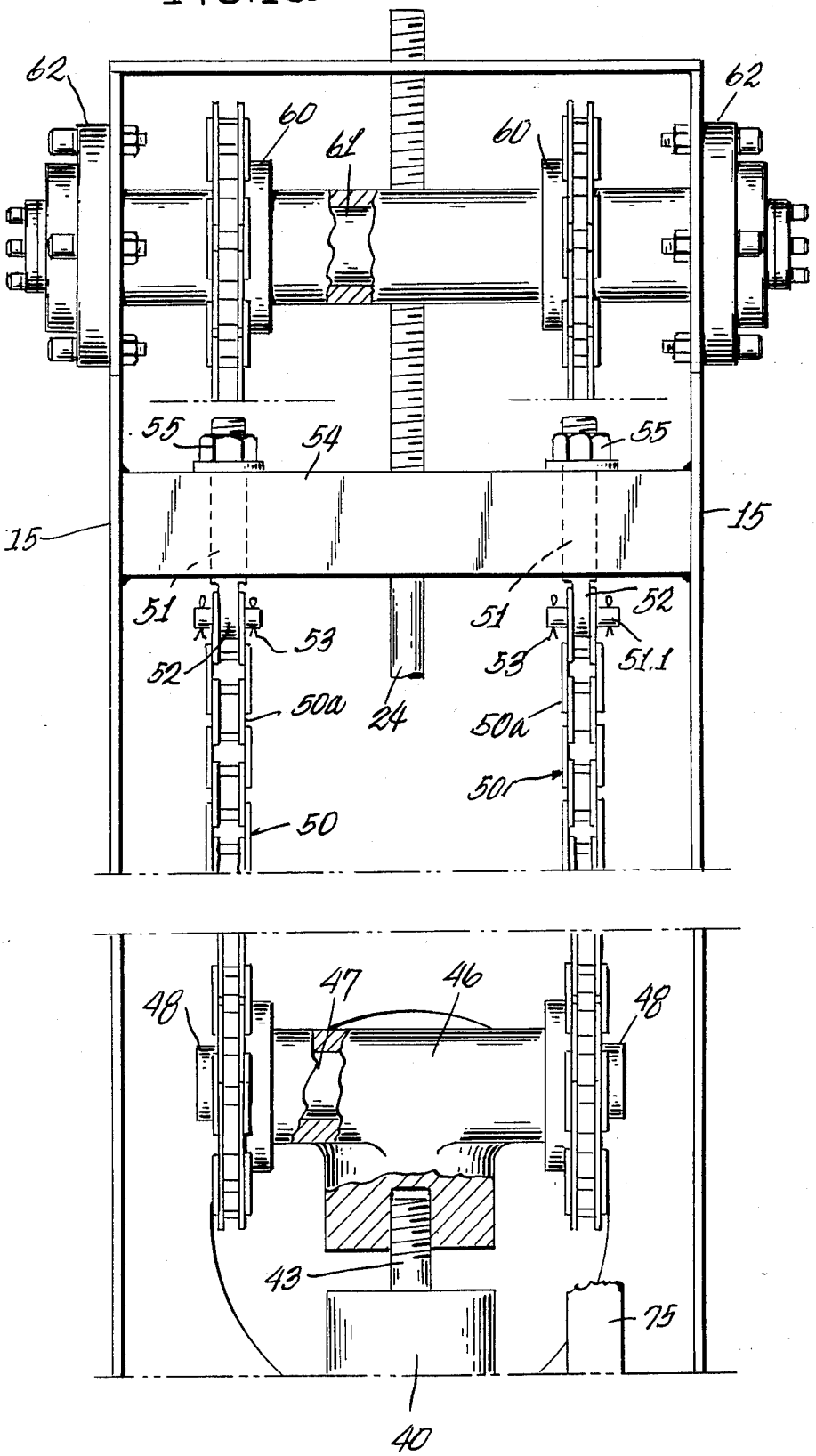
FIG. 10 is an enlarged, fragmentary view looking from the rear of the tower, and with the limit switch structure fragmentally shown.

The cross head has internal bearings for a cross shaft 47 and sprocket wheels 48,48 are fixed on opposite ends of the shaft. A pair of chains 50 are trained under and around each sprocket wheel, the rear vertical reach 50*a* of each chain having its upper end attached to a stud 51 (FIG. 10) by means of a pin 51.1 which extends through aligned holes in the upper links of the chain and a hole in the lower end 52 of the stud 51. Cotter pins 53 hold the pin 51.1 against unintentional displacement. A cross bar 54 is welded between side plates 15,15 and has a pair of vertical holes to pass the respective studs 51. The studs are threaded to receive nuts 55 and adjustment of the latter will provide for equalization of the load on the chains 50.

The forward vertical reach 50*b* of the chains 50 extend upwardly and over and around a pair of sprocket wheels 60 which are fixed to a shaft 61, the opposite ends of which are journalled in bearings 62 which are bolted to the upper ends of respective side plates 15 of the tower. The lower terminal links 63 of the chains 50 have openings which are aligned with an opening in the upper end 64 of a stud 65, the aligned openings passing a pin 64.1 which is held in place by cotter pins 64.2. The studs 65 pass through openings in a cross head 66 and nuts 67 are threaded on the studs to provide for equalization of the load on the chains 50.

The polish rod 24 is contained within a vertical slot 70 located centrally of the cross head 66 and a plate 71 is bolted to the cross head 66 to prevent lateral escape of the polish rod. The upper end of the polish rod is threaded for the reception of a nut 72 to insure that the polish rod will be moved upwardly when the cross head 66 is raised. Instead of threading the rod, the latter may have a series of vertically-spaced holes (not shown) to selectively receive a cross pin (not shown) the latter serving the function of the nut 72.

Figure 11:
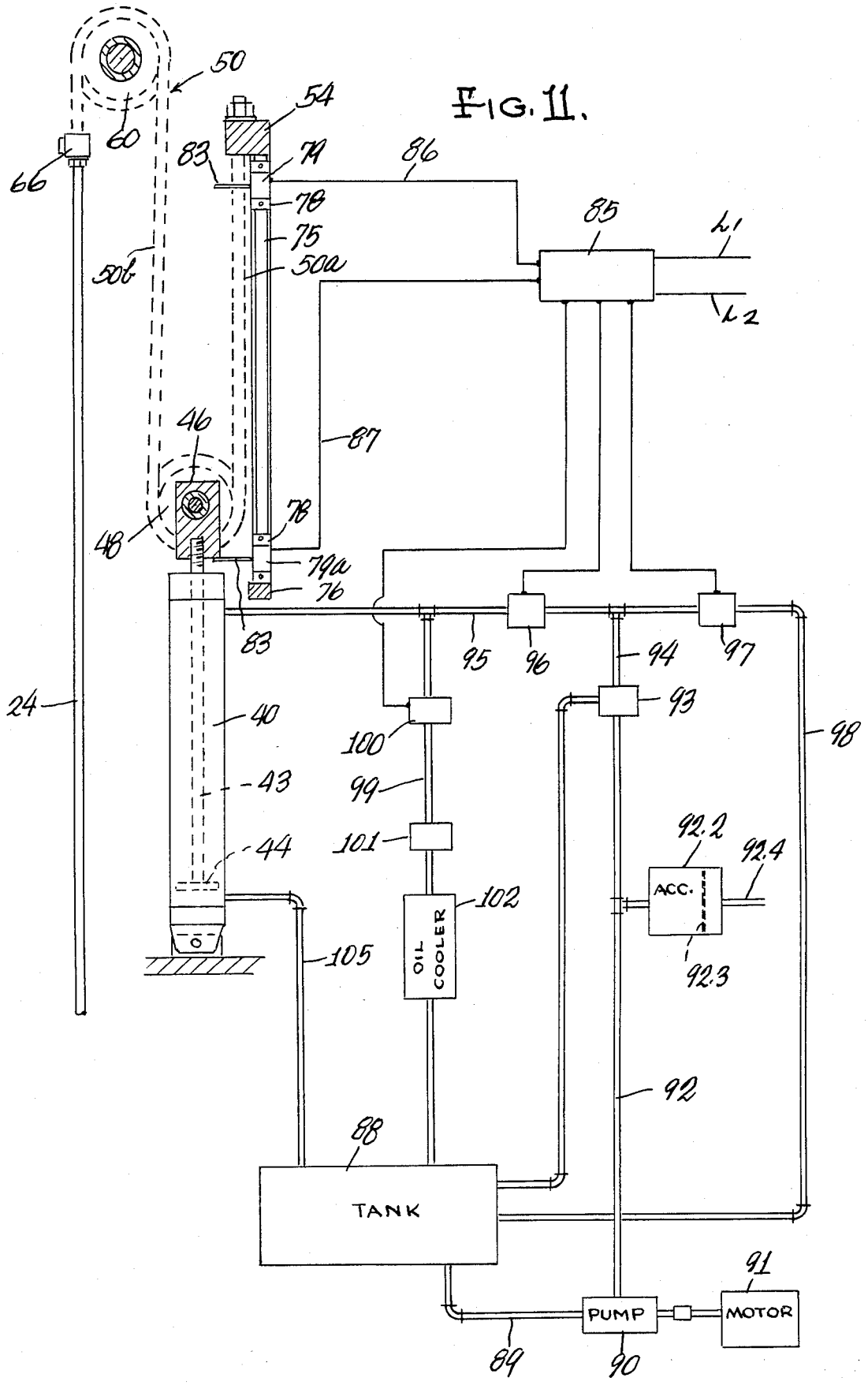
FIG. 11 is a diagramatic view, showing hydraulic and electrical connections.

With the parts in the position shown in FIGS. 3 and 11, the piston 44 has been forced to its innermost position within the cylinder so that the chains 50 have lifted the polish rod to its uppermost position. Since a string of sucker rods (not shown) are connected to the lower end of the polish rod, they combine to form a very substantial weight to be lifted by the hydraulic cylinder. Thus, the construction as particulary shown in FIG. 3 provides a most effective way of lifting the heavy weight.

Figure 4:
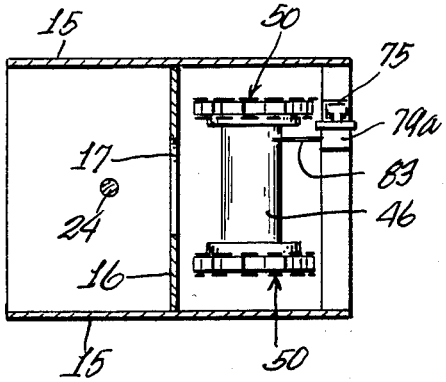
FIG. 4 is a transverse sectional view, corresponding to the line 4—4 of FIG. 3.
Figure 5:
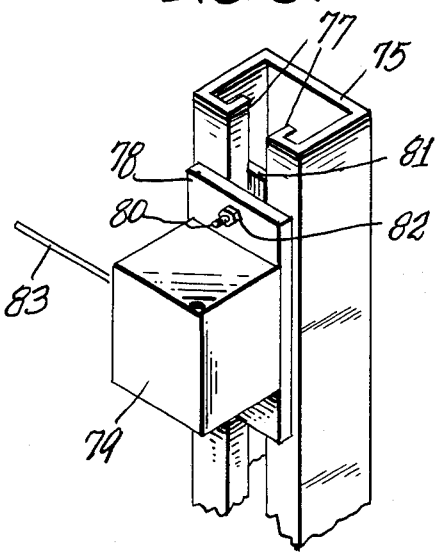
FIG. 5 is an enlarged fragmentary perspective view showing a detail.

The stroke of the cylinder 40 may be varied easily by the simple use of a conventional wrench. As seen in FIGS. 3, 4 and 11, a track 75 is welded between the cross bar 54 at the upper end, and a bottom bar 76 at the lower end. As seen in FIG. 5, the track is in the form of a metal channel which has inwardly turned legs 77 at the side openings therein. A metal plate 78 overlies the side of the channel and has a commercially-available limit switch 79 connected thereto. A bolt 80 has a head secured to a small inside plate 81, the threaded shank of the bolt passing through a hole in the plate 78 and a nut 82 is threaded on the bolt 80 to clamp the plate to the track. Although not seen, a similar bolt connection is provided at the lower end of the plate.

Two limit switches 79 and 79*a* (see FIG. 3) are adjustably mounted on the track 75, their adjusted positions determining the length of the stroke of the piston rod 43. Each limit switch has an operating rod 83 in position to be engaged by the upper or lower surface of the cross head 46.

The power supply for my improved pump jack is in the form of a neat, small unit that will fit in the back of a pickup truck and only a three-line hookup between pump and tower is necessary, and may be quickly made.

Referring particularly to FIG. 11, an electric relay 85 receives power from lines L1 and L2 which may lead from a standard 110-volt source, or if not available, from a 12-volt battery. A conductor 86 connects top limit switch 79 to relay 85, and a conductor 87 connects bottom limit switch 79*a* to the relay.

A tank 88 contains the system operating oil and a line 89 leads from the tank to a pump 90 which may be of standard construction. The pump 90 is driven by a motor 91, either gasoline or electric, whichever is available or preferred. A line 92 connects the outlet of the pump to a pressure relief valve 93 which bleeds to the tank any excess liquid pressure. An accumulator 92.2 of standard design, is in communication with line 92 and has the usual diaphragm 92.3 which divides the accumulator tank into an oil side and a gas side. A line 92.4 is adapted to introduce gas under a predetermined pressure to the gas side of the accumulator, the purpose being to cushion the surge of oil from the pump 90.

From relief valve 93, a line 94 leads to line 95 which connects to the upper port of the hydraulic cylinder 40. Solenoid valves 96 and 97 are interposed in line 95 which has a continuation 98 leading back to tank 88. Extending between line 95 and tank is a line 99 which has inserted therein a solenoid valve 100, a flow regulator valve 101, and an oil cooler 102, the latter being an optional item.

In the position of parts shown in FIG. 11, the piston has just reached its lowest position wherein the cross head 46 has engaged the operator 83 of the lower limit switch 79*a*. In this position of parts, the polish rod 24, and connected sucker rods, have been elevated to the highest point determined by the adjusted position of the lower limit switch 79*a*. When the operator 83 of switch 79*a* is moved, the relay 85 actuates contacts (not shown) to effect closing of valve 96 and opening of valves 97 and 100. This cuts off pressurized liquid to the upper port of the cylinder 40 so that the weight of the polish rod and connected sucker rods pulls the piston rod 43 and piston 44 upwardly.

Fluid from the upper part of the cylinder 40 flows through line 95, valve 100, speed regulator 101, oil cooler 102 and back to tank 88. The speed at which the sucker rods descend into the well is determined by the setting of the regulator 101.

When piston rod 45 and piston rod 44 reach the upper limit of the stroke, the cross head 46 will engage and move the operator 83 of the upper limit switch 79 so that the relay 85 now actuates its contacts to close valves 97 and 100 and open valve 96 to thus cause pressurized fluid from the pump 90 to flow to the upper port of cylinder 40 to drive piston 44 downwardly.

A bleed line 105 connects the lower port of the cylinder 40 with the tank 88. The line 98 bleeds liquid back to the tank when the valve 96 is closed.

Figure 12:
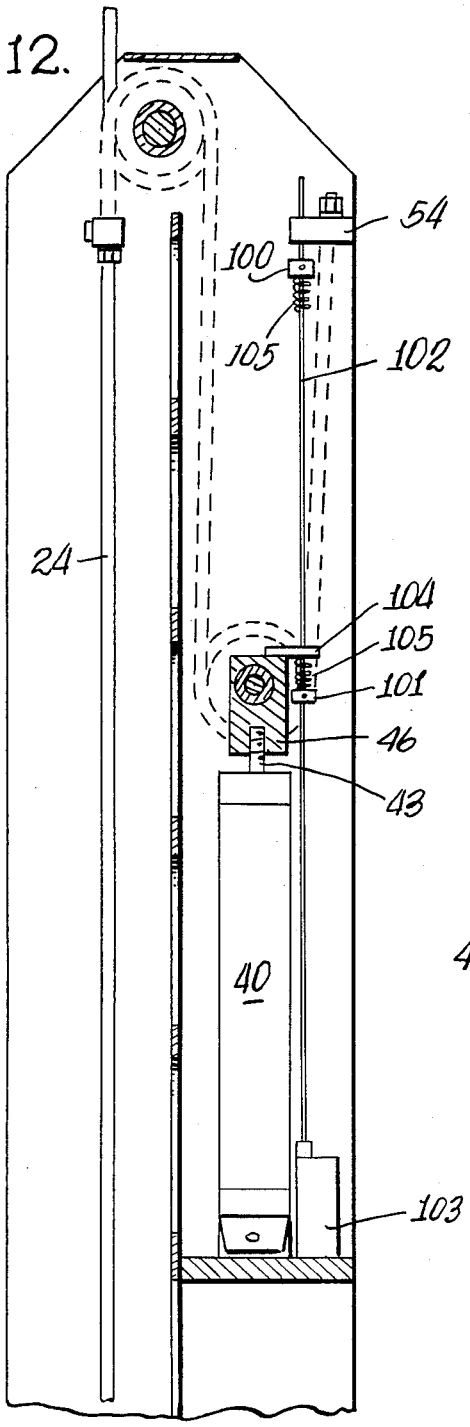
FIG. 12 is a view similar to FIG. 3, but showing a mechanical control for the hydraulic cylinder.
Figure 13:
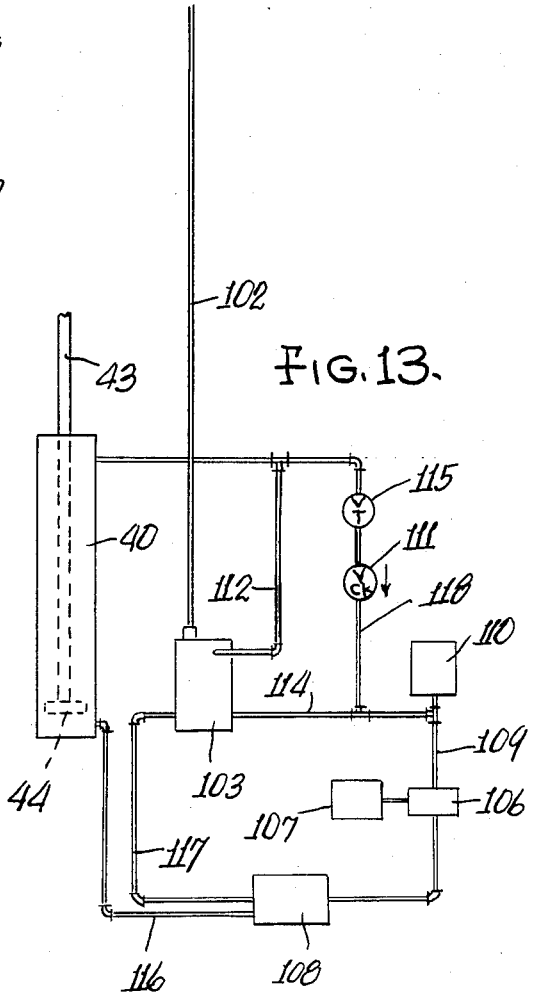
FIG. 13 is a schematic representation of the hydraulic circuit for the control shown in FIG. 12.

A mechanical control for the hydraulic cylinder 40 is shown in FIGS. 12 and 13. The limit switches 79 and 79*a* are omitted, and are replaced by upper and lower stroke blocks 100 and 101 respectively. The upper block 100 is fixed to a vertically reciprocable rod 102 and the lower block is adjustable along this rod. The crossbar 54 provides a bearing for the upper part of the rod 102 and the lower part of this rod is connected to the actuator member (not shown) of a spool valve 103. The valve is of conventional construction wherein the spool is shifted to one or the other of its positions by reciprocation of the rod, and is yieldably held in either position by a spring-pressed ball detent.

The cross head 46 has a trip finger 104 movable therewith to engage the upper block 100 when the piston rod 43 has been drawn upwardly, and to engage the lower block 101 when the piston rod has been drawn downwardly. The springs 105 assist in the correct position of the valve spool in that they permit snap action thereof from one detent-held position to the other.

The hydraulic circuit is shown in FIG. 13 wherein a pump 106 is driven by a motor 107 to withdraw oil from a tank 108 and force it through a high pressure line 109 in which an accumulator 110 is interposed. The line 109 connects with line 114 which leads to the valve 103, and with line 118 which leads to the rod end of the cylinder 40. The line 118 has a check valve 111 which is checked in the up motion of the sucker rod 24, and a flow control valve 115. A line 112 connects the rod end of the cylinder to the valve 103 and a bleed line 116 connects the blank end of the cylinder to tank 108.

When the cylinder 40 has drawn the sucker rod to its uppermost position, the trip finger 104 pushes against spring 105 at lower block 101 to move the rod 102 downwardly an amount sufficient to move the spool in the valve 103 to cause an exhaust of the oil in the cylinder. This exhaust oil will flow through the flow control valve 115 (this valve controlling the speed of descent of the sucker rod) through lines 118 and 114, through valve 103 and line 117 and back to tank 108. This action causes the cross head 46 to move upwardly until the trip finger 104 pushes against spring 105 at top block 100, whereupon the rod 102 is moved upwardly an amount sufficient to move the spool in the valve 103 to block flow of high pressure oil to tank and thereby cause such oil to flow from pump 106, through line 114, valve 103 and line 112 to the rod end of the cylinder to drive the cross head 46 downwardly. The spool in valve 103, under these conditions, will block flow of oil through line 117 to tank 108.

I claim:

1. A pump jack for pumping a liquid such as oil, brine and the like from a well having a casing at its head and a tube on said casing through which the polish rod at the top of a string of sucker rods extends outwardly and upwardly therefrom, said casing providing an exit for the pumped liquid, said pump jack comprising:

a tower disposed upright at the well head, said tower including two elongated vertically-disposed side plates held in facing spaced-apart relation by an elongated vertically-disposed intermediate plate extending crosswise of said side plates, a hydraulic cylinder having one end secured to said tower near a lower end thereof, said cylinder having a piston rod extending outwardly of the opposite upper end thereof, rotatable sprocket means supported on a shaft carried near the upper end of said tower, chain means having one end connected for lifting and lowering movement to said piston rod of said cylinder upper end, said chain means extending upwardly and over and around said sprocket means and downwardly therefrom and having its other end connected to an upper portion of said polish rod, said hydraulic cylinder being constructed and arranged so that the piston therein is driven in a direction toward its said one end to lift said polish rod, with said hydraulic cylinder being vertically-disposed and having its lower end secured to at least certain of said side and intermediate plates and located at one side surface of said intermediate plate, the latter terminating at its upper end short of said rotatable sprocket means and said sprocket means located so that said chain means extends upwardly from its connection to said cylinder adjacent to said one side surface of said intermediate plate and extends downwardly from said sprocket means for connection to said polish rod adjacent to the opposite side surface of said intermediate plate whereby the latter is in position to reenforce against stress generated when said polish rod is raised and lowered.

2. The construction according to claim 1 including means for limiting the stroke of said cylinder in either direction.

3. The construction according to claim 2 including means for adjusting the point of engagement of said piston rod engaging means with said stroke limiting means, thereby to predetermine a desired stroke length.

4. The construction according to claim 2 wherein said piston rod has means for engaging said stroke limiting means at either end of its stroke.

5. The construction according to claim 4 wherein said means limiting the cylinder stroke includes hydraulic circuit means controlled in response to engagement of said stroke limiting means.

6. A pump jack for pumping a liquid such as oil, brine water and the like from a well having a casing at its head and a tube on said casing through which the polish rod at the top end of a string of sucker rods extends outwardly and upwardly therefrom, said casing providing an exit for the pumped liquid, said pump jack comprising:

a tower formed of steel plates welded together, and including two elongated vertically-disposed side plates and an elongated vertically-disposed plate welded crosswise of said side plates intermediate the edge margins thereof and substantially coextensive with said side plates but terminating short of the upper ends thereof, a hydraulic cylinder having a lower end secured to a shelf welded to at least certain of said side and intermediate plates, said cylinder being disposed upright along one side surface of said intermediate plate and having a piston rod extending outwardly of the upper end thereof, a first cross head secured to said piston rod and supporting a first shaft whose axis is horizontal and disposed substantially parallel to said one side surface of said intermediate plate, a pair of first rotatable sprockets carried by said first shaft, a second shaft disposed crosswise of said side plates in bearings supported by the latter in position above the upper margin of said intermediate plate, the axis of said second shaft being horizontal and parallel to the axis of said first shaft, said second shaft carrying a pair of second rotatable sockets, a pair of chains adapted to cooperate with respective ones of said pairs of first and second sprockets, one end of each chain being secured to a crossbar connected across said side plates at a location above said upper end of said cylinder, each chain extending downwardly from its one secured end, under and around a respective one of said first pair of sprockets, upwardly along said one side surface of said intermediate plate and over and around a respective one of said second pair of sprockets, and downwardly therefrom along the opposite side surface of said intermediate plate and having its other end connected to a second cross head at a respective one of opposite sides of a connection of said polish rod to said second cross head, said cylinder being constructed and arranged so that the piston therein is driven downwardly to actuate said chains to lift said polish rod.

7. The construction according to claim 6 wherein the end of at least one chain connected to said crossbar is adjustably connected to provide for equalization of stress on both chains.

8. The construction according to claim 6 wherein the end of at least one chain is adjustably connected to said second cross head to provide for equalization of stress on both chains.

9. The construction according to claim 6 and including a vertical track fixed to said tower, and a pair of limit switches mounted on said track so that at least the upper one is movable toward and away from the lower one, each limit switch having an operating member adapted to be engaged by said first cross head and operable when so engaged to define the operating limits of said cylinder.

10. The construction according to claim 9 and further comprising a power unit including an oil tank, a pump connected to said tank and driven by a motor, an accumulator in the high pressure line from the pump to cushion the surge of oil from the pump, two branch lines extending from opposite ends of said high pressure line at a location beyond said accumulator, one branch line leading to the upper port of said cylinder and having a first solenoid-operated valve therein, the other branch line leading back to tank and having a second solenoid-controlled valve therein, a return line connected to said one branch line between said cylinder upper port and said first solenoid-controlled valve, said return line having a third solenoid-controlled valve therein and also a flow regulator valve, and a relay electrically connected to a source of power and to said limit switches and to said first, second and third solenoid-controlled valves in a manner to effect closing of said first valve and opening of said second and third valves when said lower limit switch is activated, whereby the weight of said polish rod and connected sucker rods pulls the cylinder rod upwardly, said regulator valve regulating the speed of descent of said polish rod, said relay effecting opening of said first solenoid-controlled valve and closing of said second and third valves when said upper limit switch is activated so that oil under pressure enters said cylinder upper port to drive the piston downwardly and thereby raise said polish rod and connected sucher rods.

11. A pump jack for pumping a liquid such as oil, brine and the like from a well having a casing at its head and a tube on said casing through which the polish rod at the top of a string of sucker rods extends outwardly and upwardly therefrom, said casing providing an exit for the pumped liquid, said pump jack comprising:

a tower disposed upright at the well head, said tower including two elongated verticaly-disposed side plates held in facing spaced-apart relation by an elongated vertically-disposed intermediate plate extending crosswise of said side plates, a hydraulic cylinder having one end secured to said tower near a lower end thereof, said cylinder having a piston rod extending outwardly of the opposite end thereof, a cross-head secured to said piston rod and supporting a shaft and first rotatable sprocket means, second rotatable sprocket means supported on a shaft carried near the upper end of said tower in cooperating relationship with said first rotatable sprocket means, chain means having one end secured to said tower at a location above said one end of said cylinder, said chain means extending downwardly from said one secured end, under and around said first sprocket means, upwardly and over and around said second sprocket means, and downwardly therefrom and having its other end connected to an upper portion of said polish rod, said hydraulic cylinder being constructed and arranged so that the piston therein is driven in a direction toward its said one end to lift said polish rod, with said hydraulic cylinder being vertically-disposed and having its lower end secured to at least certain of said side and intermediate plates and located at one side surface of said intermediate plate, the latter terminating at its upper end short of said second rotatable sprocket means and the latter located so that said chain means extends upwardly from said first sprocket means adjacent to said one side surface of said intermediate plate and extends downwardly from said second sprocket means for connection to said polish rod adjacent to the opposite side surface of said intermediate plate whereby the latter is in position to reinforce against stress generated when said polish rod is raised and lowered.

12. The construction according to claim 11 wherein said tube on said well casing has two vertically-spaced upwardly facing shoulders, the lower one being of larger diameter than the upper one, each shoulder providing a horizontal ledge, said shoulders having different vertical spacing in different wells, said tower having a first horizontally-disposed support plate at its lower portion, said plate having a slot therein opening from a side margin thereof, said slot being slightly wider than the diameter of said tube above said first shoulder but of less width than the ledge provided by the latter, said tower having a second horizontally-disposed support plate below side first plate, said second plate having a slot therein opening from a side margin thereof, said slot being slightly wider than the diameter of said tube above said second shoulder but of less width than the ledge provided by the latter, the slots in said first and second plates being aligned so that said support plates may be assembled with said tube by lateral bodily movement, and adjustment means between said first and second support plates to vary the distance therebetween to adjust the vertical spacing of said plates so the said first plate rests upon the ledge of said upper shoulder and said second support plate rests upon the ledge of said lower shoulder to thereby adequately support the weight of said tower and the components carried thereby, and clamp means to releasably hold at least one support plate against disassembly from said tube.

13. The construction according to claim 11 wherein said tube on said well casing has an upwardly facing shoulder, said tower having a horizontally disposed support plate at its lower portion, said plate having a slot therein opening from a side margin thereof, said slot being slightly wider than the diameter of said tube but of less width than said shoulder, so that said support plate may be assembled with said tube by lateral bodily movement to seat said tube within said slot with the lower surface of said support plate bearing on said shoulder.

14. The construction according to clam 13 wherein clamp means releasably holds said support plate against disassembly from said tube.

15. The construction according to claim 11 wherein the stroke of said cylinder is defined by spaced limit switch means engaged by the cross head which is secured to said piston rod.

16. The construction according to claim 15 wherein at least the upper limit switch is movable for adjustment of its position.

17. The construction according to claim 11 including means for limiting the stroke of said cylinder in either direction.

18. The construction according to claim 17 including means for adjusting the point of engagement of said piston rod engaging means with said stroke limiting means, thereby to predetermine a desired stroke length.

19. The construction according to claim 17 wherein said piston rod has means for engaging said stroke limiting means at either end of its stroke.

20. The construction according to claim 19 wherein said means limiting the cylinder stroke includes hydraulic circuit means controlled in response to engagement of said stroke limiting means.

* * * * *